US006451195B1

(12) United States Patent
Watanabe

(10) Patent No.: US 6,451,195 B1
(45) Date of Patent: Sep. 17, 2002

(54) SYSTEM AND METHOD FOR ELECTROLYTIC PLATING USING A MAGNETIC FIELD

(75) Inventor: Masahito Watanabe, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/611,277

(22) Filed: Jul. 6, 2000

(30) Foreign Application Priority Data

Jul. 7, 1999 (JP) ..... 11-193081

(51) Int. Cl.[7] ..... C25D 21/00; C25D 17/02

(52) U.S. Cl. ..... 205/89; 205/157; 205/291; 204/227; 204/DIG. 5

(58) Field of Search ..... 205/89, 157, 291; 204/DIG. 5, 227

(56) References Cited

U.S. PATENT DOCUMENTS 5,316,642 A * 5/1994 Young, Jr. et al. ..... 204/DIG. 5

OTHER PUBLICATIONS

Dash et al, Electrothinning and Electrodeposition of Metals in Magnetic fields, J. Electrochem. Soc. (USA) vol. 119, No. 1 (Jan. 1972).*

* cited by examiner

*Primary Examiner*—Arun S. Phasge

(74) *Attorney, Agent, or Firm*—Scully, Scott, Murphy & Presser

(57) ABSTRACT

An electrolytic plating system includes a coil for generating a magnetic field in the direction perpendicular to the subject surface of a wafer on which a Cu film is to be formed. The current components perpendicular to the magnetic field stirs the electrolytic solution without using a stirrer, thereby achieving a uniform thickness for the Cu film without a void therein.

8 Claims, 2 Drawing Sheets

SYSTEM AND METHOD FOR ELECTROLYTIC PLATING USING A MAGNETIC FIELD

BACKGROUND OF THE INVENTION (a) Field of the Invention

The present invention relates to a system and a method for electrolytic plating and, more particularly, to a technique for forming a metallic film on a semiconductor wafer by using an electrolytic plating technique with a magnetic field.

(b) Description of the Related Art

Aluminum (Al) generally used for wiring between semiconductor elements in an LSI is to be replaced by copper (Cu) in view of the lower electric resistance of the latter. An electrolytic plating technique is known as a method for forming a Cu film on a wafer, wherein Cu ions are deposited on the subject surface of the wafer by conducting current through an aqueous solution of electrolytic substance including Cu ions to the wafer for deposition of the Cu ions.

In fabrication of the LSI, it is important that the Cu film has a uniform thickness on the subject surface of the wafer. However, the electrolytic plating technique generally incurs a problem in that a thicker Cu film is formed on the peripheral area of the wafer compared to the central area thereof. To solve this problem in the current electrolytic plating technique, the electrolytic solution is stirred by a stirrer or added with additives for obtaining a uniform thickness for the Cu film.

The technique for stirring the electrolytic solution incurs the ingress of contaminants or contaminating substances through the stirrer, whereas the technique using the additives also involves attachment of contaminants to the wafer. The stirring technique in fact does not afford a sufficient uniformity in the thickness of the resultant film because the stirring itself cannot accurately control the flow of the electrolytic solution.

In addition, an ununiform current density occurs along the resistance distribution of subject surface of the wafer, which also incurs the uneven thickness of the resultant film. In particular, in the case of a lower resistivity of the wafer, a higher concentration of dopant is introduced in the semiconductor substrate. This increases the variance in the resistivity and thus degrades the uniformity of the resistivity distribution, whereby a uniform thickness is difficult to achieve.

SUMMARY OF THE INVENTION

In view of the above, it is an object of the present invention to provide a system and a method for electrolytic plating on the surface of a wafer with a uniform thickness.

The present invention provides a method for electrolytic plating on a subject surface of a wafer including the steps of contacting a subject surface of a wafer with electrolytic solution, applying a DC voltage between the wafer and the electrolytic solution while applying a magnetic field in the electrolytic solution.

In accordance with the method of the present invention, the magnetic field applied to the current components which are perpendicular to the magnetic field stirs the electrolytic solution to obtain a uniform distribution of ions of the electrolytic substance in the electrolytic solution without using a stirrer, thereby preventing the ingress of the contaminants. In addition, the magnetic field strength can be controlled with ease by controlling the applied voltage, which effectively preventing the ununiform thickness of the resultant film.

The above and other objects, features and advantages of the present invention will be more apparent from the following description, referring to the accompanying drawings.

PREFERRED EMBODIMENT OF THE INVENTION

Figure 1:
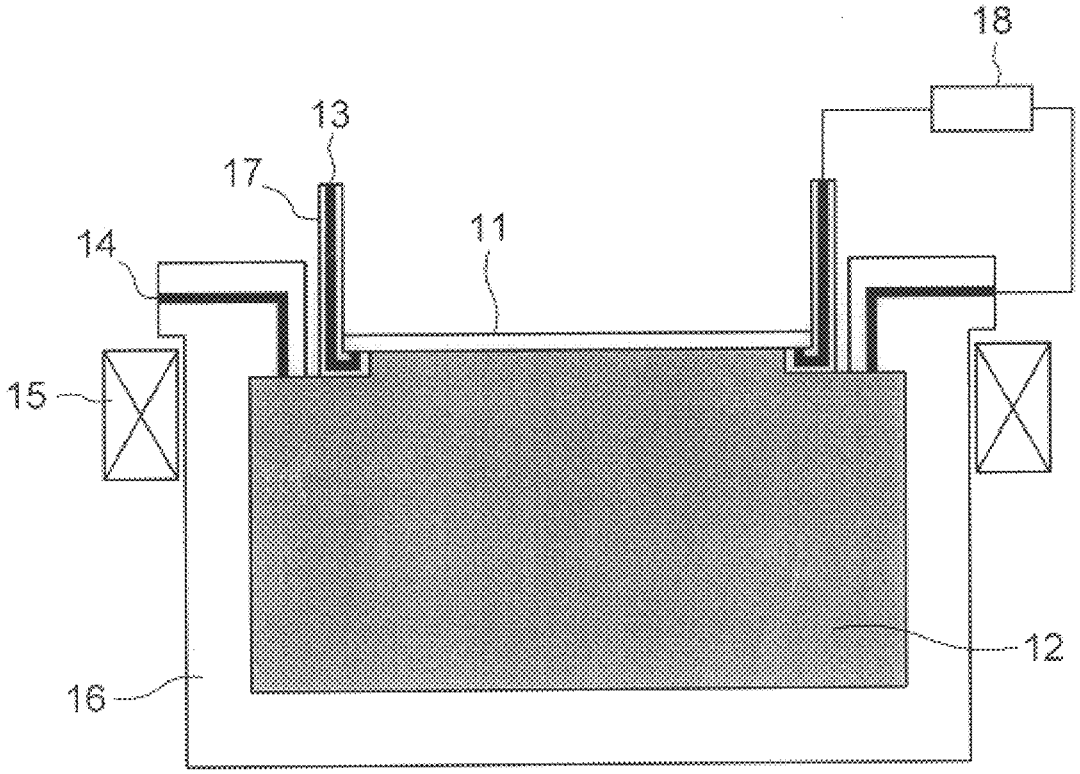
FIG. 1 is an electrolytic plating system for depositing a Cu film on a wafer by using an electrolytic plating method according to an embodiment of the present invention.

Now, the present invention is more specifically described with reference to accompanying drawings, wherein similar constituent elements are designated by related reference numerals.

Referring to FIG. 1, an electrolytic plating system according to an embodiment of the present invention is used for depositing a Cu film on a wafer 11 by using electrolytic solution 12 received in a cylindrical container 16 having a top opening. The wafer 11 is supported by a support member 17 at the top opening of the container 16, with the subject surface of the wafer 11 on which the Cu film is to be deposited being directed downward.

The wafer 11 is shifted by the support member 17 in the vertical direction and stopped at the location wherein the subject surface of the wafer 11 is in contact with the electrolytic solution 12. Other surfaces other than the subject surface may be covered by a protective film. A cathode 13 and an anode 14 are electrically connected to the wafer 11 and the top surface of the electrolytic solution 12, respectively. A solenoid 15 is wound on the outer surface of the cylindrical container 16 for generating a magnetic field which is perpendicular to the subject surface in the vicinity thereof. A power source 18 is connected to the anode 14 and the cathode 13. The subject surface may be a substrate surface of the wafer. The substrate may be made of silicon. The electrolytic solution 12 may contain Cu ions for deposition thereof.

The current in the solenoid 15 may be controlled for obtaining a desired thickness for the resultant Cu film. The configuration and the location of the solenoid 15 may be adjusted after conducting a variety of experiments so that an optimum stirring can be obtained. The location of the solenoid 15 may be determined so that the maximum for the current components which are perpendicular to the magnetic field is obtained in the electrolytic solution 12

Embodiments #1 to #4

First through fourth samples of the silicon wafer with 20 cm in diameter were subjected to the deposition of a Cu film up to a thickness of 500 nm on the entire subject surface of the silicon, to obtain embodiments #1 to #4 of the present invention. These wafers had respective resistivities (or specific resistances) of 10, 1, 0.1, 0.01 Ω-cm. The thicknesses of the resultant Cu films were subjected to measurements at several points on the subject surface, followed by calculation of the distribution thereof.

Figure 2:
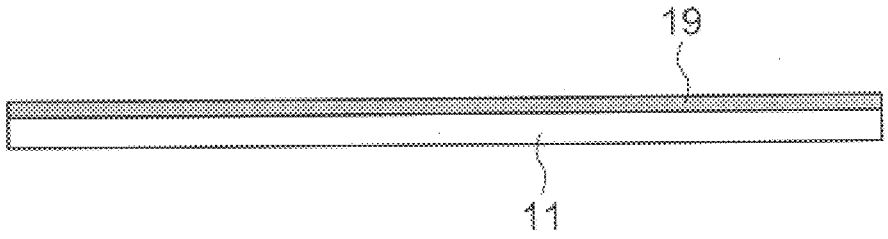
FIG. 2 is a sectional view of a semiconductor wafer on which a Cu film is deposited by the system of FIG. 1.

During the deposition, both the current (A: ampare) supplied from the power source 18 and the magnetic field (T.: tesla) generated by the solenoid 15 were changed. The numbers of voids in the resultant Cu films were also observed along with the thicknesses of the Cu films. The results of observation of the number of voids and the calculation of distribution of the film thickness are tabulated in Table 1. The structure of the resultant Cu films is shown in FIG. 2.

The distribution D(%) of the film thickness is calculated by the following formula:

$$D(\%)=(d_p-d_c)/d_c\times 100 \quad (1)$$

wherein $d_p$ and $d_c$ are the thicknesses at the periphery and the center, respectively, of the wafer.

In Table 1, results of observation for presence or absence of the impurities on the surface of the Cu film are also tabulated.

TABLE 1

| Em. | Magnetic field (T) | Current (A) | Resistivity Ω-cm | Voids | Distri-bution (%) | Impurity |
|---|---|---|---|---|---|---|
| #1 | 0.01–1.0 | 0.01–1.0 | 10 | absent | 0.5 | absent |
| #2 | 0.01–1.0 | 0.01–1.0 | 1 | absent | 0.5 | absent |
| #3 | 0.01–1.0 | 0.01–1.0 | 0.01 | absent | 0.5 | absent |
| #4 | 0.01–1.0 | 0.01–1.0 | 0.001 | absent | 0.5 | absent |

Embodiments #5 to #8

Embodiments #5 to #8 of silicon wafers having resitivities of 10, 1, 0.1 and 0.01 Ω-cm, respectively, and a diameter of 30 centimeters were also subjected to deposition of a Cu film up to a thickness of 500 nm on the entire subject surface of each wafer. An aqueous solution of copper sulfate was used as the electrolytic solution, with the applied magnetic field and the supplied current being changed. The thicknesses of the resultant Cu films were subjected to measurements at several points in the surface of the Cu films. The distributions of the film thicknesses obtained by the formula and the number of voids detected were tabulated in Table 2. FIG. 2 also shows the resultant Cu film.

TABLE 2

| Em. | Magnetic field (T) | Current (A) | Resistivity Ω-cm | Voids | Distri-bution (%) | Impurity |
|---|---|---|---|---|---|---|
| #5 | 0.01–1.0 | 0.01–1.0 | 10 | absent | 0.5 | absent |
| #6 | 0.01–1.0 | 0.01–1.0 | 1 | absent | 0.5 | absent |
| #7 | 0.01–1.0 | 0.01–1.0 | 0.01 | absent | 0.5 | absent |
| #8 | 0.01–1.0 | 0.01–1.0 | 0.001 | absent | 0.5 | absent |

Comparative Examples #1 to #8

Figure 3:
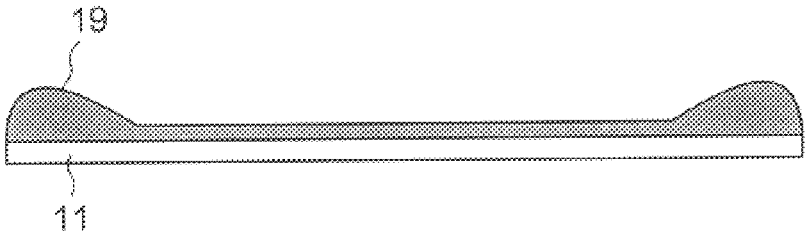
FIG. 3 is a sectional view of another semiconductor wafer on which a Cu film is deposited by using a conventional electrolytic plating technique.

For comparison against the embodiments, comparative examples were also prepared by using a conventional method wherein a magnetic field was not applied to the current in the electrolytic solution. An aqueous solution of copper sulfate was used as the electrolytic solution for deposition of a Cu film, with a stirrer immersed therein for stirring the electrolytic solution at the bottom of the container. The comparative examples #1 to #8 had resistivities and diameters which are similar to those of the embodiments #1 to #8, respectively. The results of the measurements are tabulated in Table 3. FIG. 3 shows the structure of the resultant Cu film.

TABLE 3

| Co. Ex. | Magnetic field (T) | Diameter | Resistivity Ω-cm | Voids n/cm$^2$ | Distri-bution (%) | Impurity |
|---|---|---|---|---|---|---|
| #1 | 0.01–1.0 | 20 | 10 | 10 | 5.0 | carbon |
| #2 | 0.01–1.0 | 20 | 1 | 5 | 5.0 | carbon |
| #3 | 0.01–1.0 | 20 | 0.01 | 5 | 5.0 | carbon |
| #4 | 0.01–1.0 | 20 | 0.001 | 5 | 5.0 | carbon |
| #5 | 0.01–1.0 | 30 | 10 | 20 | 10.0 | carbon |
| #6 | 0.01–1.0 | 30 | 1 | 15 | 10.0 | carbon |
| #7 | 0.01–1.0 | 30 | 0.01 | 10 | 10.0 | carbon |
| #8 | 0.01–1.0 | 30 | 0.001 | 5 | 10.0 | carbon |

As understood from the comparison of the embodiments #1 to #8 against the comparative examples #1 to #8, the magnetic field applied to the current in the electrolytic solution provides an excellent Cu film which has a uniform thickness without voids and contaminating substances.

Embodiments #9 to #16

Figure 4:
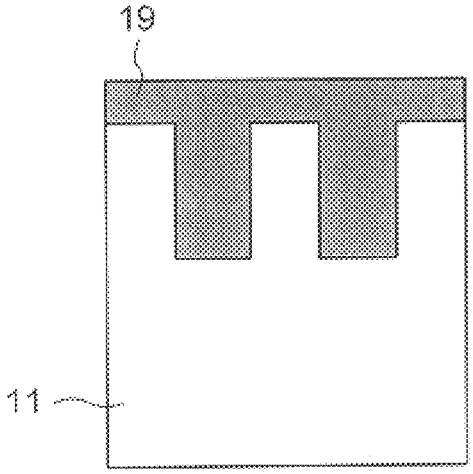
FIG. 4 is a sectional view of another semiconductor wafer on which a Cu film is deposited in through-holes by using a electrolytic plating technique according to the embodiment.

Embodiments #9 to #16 of the wafer were also prepared having diameters of 20 and 30 centimeters and through-holes therein, each of which is 300 nm wide and 600 nm deep. These embodiments are subjected to deposition of Cu films according to the present invention. An aqueous solution of copper sulfate was used as the electrolytic solution. The section of the Cu film was observed, and the volumetric ratio of the voids to the through-hole was calculated. Table 4 shows the results of the measurements, and FIG. 4 shows the structure of the resultant Cu film.

TABLE 4

| Ex. | Magnetic field (T) | current (A) | diameter (cm) | resistivity (Ω-cm) | void (%) |
|---|---|---|---|---|---|
| #9 | 0.01–0.5 | 0.01–10 | 30 | 10 | 0 |
| #10 | 0.01–0.5 | 0.01–10 | 30 | 1 | 0 |
| #11 | 0.01–0.5 | 0.01–10 | 30 | 0.01 | 0 |
| #12 | 0.01–0.5 | 0.01–10 | 30 | 0.001 | 0 |
| #13 | 0.01–0.5 | 0.01–10 | 40 | 10 | 0 |
| #14 | 0.01–0.5 | 0.01–10 | 40 | 1 | 0 |
| #15 | 0.01–0.5 | 0.01–10 | 40 | 0.01 | 0 |
| #16 | 0.01–0.5 | 0.01–10 | 40 | 0.001 | 0 |

Comparative Examples #9 to #16

Figure 5:
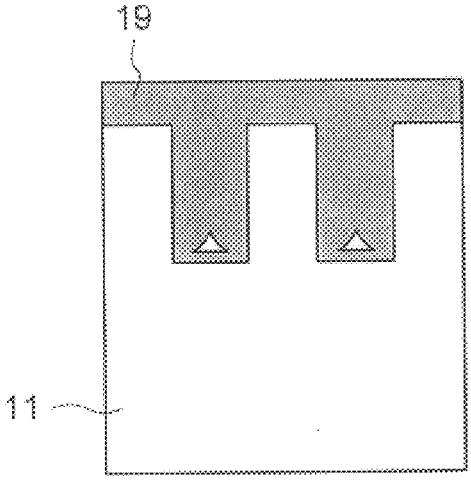
FIG. 5 is a sectional view of another semiconductor wafer on which a Cu film is deposited in through-holes by using a conventional electrolytic plating technique.

Comparative examples #9 to #16 having diameters 20 and 30 centimeters and through-holes, each of which is 300 nm wide and 600 nm deep, were also prepared similarly to the embodiments #9 to #16 except that a conventional technique is used in the deposition wherein a magnetic field is not applied to the current in the electrolytic solution. Table 5 shows the results of the measurements for the comparative examples, and FIG. 5 shows the structure of the resultant Cu film.

TABLE 5

| Co. Ex. | Current (A) | Diameter (cm) | Resistivity (Ω-cm) | Void (%) |
|---|---|---|---|---|
| #9 | 0.01–10 | 20 | 10 | 10 |
| #10 | 0.01–10 | 20 | 1 | 10 |
| #11 | 0.01–10 | 20 | 0.01 | 15 |
| #12 | 0.01–10 | 20 | 0.001 | 15 |

TABLE 5-continued

| Co. Ex. | Current (A) | Diameter (cm) | Resistivity (Ω-cm) | Void (%) |
|---|---|---|---|---|
| #13 | 0.01–10 | 30 | 10 | 15 |
| #14 | 0.01–10 | 30 | 1 | 15 |
| #15 | 0.01–10 | 30 | 0.01 | 15 |
| #16 | 0.01–10 | 30 | 0.001 | 20 |

As understood from the comparison of the embodiments #9 to #16 against the comparative examples #9 to #16, the electrolytic plating technique of the present invention forms an excellent Cu film in the through-holes substantially without a void.

As described above, the electrolytic plating technique of the present invention can provide a uniform thickness for the Cu film on the wafer and an excellent Cu film substantially without a void. The magnetic field as applied to the current in the electrolytic solution has a function for stirring the electrolytic solution by an electromagnetic force without using a stirrer, thereby preventing the contaminating substances from entering the Cu film through the stirrer.

Since the above embodiments are described only for examples, the present invention is not limited to the above embodiments and various modifications or alterations can be easily made therefrom by those skilled in the art without departing from the scope of the present invention.

What is claimed is:

1. A method for electrolytic plating on a subject surface of a wafer comprising the steps of contacting the subject surface of a wafer with an electrolytic solution, applying a DC voltage between the wafer and the electrolytic solution while applying a magnetic field in the electrolytic solution, wherein said magnetic field is effective to current components perpendicular to the magnetic field.

2. The method as defined in claim 1, wherein said magnetic field is substantially perpendicular to the subject surface of the wafer.

3. The method as defined in claim 1, wherein the subject surface is a surface of a semiconductor substrate.

4. The method as defined in claim 1, wherein the subject surface is a surface of a silicon substrate.

5. The method as defined in claim 1, wherein said electrolytic solution contains Cu ions.

6. The method as defined in claim 1, wherein a surface of the wafer other an the subject surface is covered with a protective film.

7. An electrolytic plating system for forming an electrolytic film on a wafer, comprising;

a container for receiving therein an electrolytic solution, a support member for supporting the wafer with a subject surface of the wafer being in contact with said electrolytic solution.

a power source for supplying DC current between said electrolytic solution and the wafer, a magnetic member for applying a magnetic field to said electrolytic solution, wherein said magnetic field is substantially perpendicular to current components of the DC current supplied by said power source.

8. The electrolytic plating system as defined in claim 7, wherein said magnetic member applies the magnetic field in a direction substantially perpendicular to the subject surface at least in a vicinity of the substrate surface.

* * * * *